United States Patent [19]

James et al.

[11] 4,183,404

[45] Jan. 15, 1980

[54] PLURAL PARALLEL TUBING WITH SAFETY JOINTS OR RELEASE FROM SUSPENDED RECEPTACLE

[75] Inventors: Henry J. James, Littleton, Colo.; Carter R. Young, Argyle, Tex.

[73] Assignee: Otis Engineering Corporation, Dallas, Tex.

[21] Appl. No.: 959,740

[22] Filed: Nov. 13, 1978

Related U.S. Application Data

[62] Division of Ser. No. 270,977, Jul. 12, 1972, Pat. No. 4,143,712.

[51] Int. Cl.[2] ..... E21B 43/00

[52] U.S. Cl. ..... 166/133; 166/363

[58] Field of Search ..... 166/54.1, 315, 363, 166/364, 72, 188, 319-324, 133

[56] References Cited

U.S. PATENT DOCUMENTS

| | | | |
|---|---|---|---|
| 3,083,767 | 4/1963 | Brown | 166/315 |
| 3,363,693 | 1/1968 | Bohlmann | 166/319 |
| 3,375,874 | 4/1968 | Cherry et al. | 166/321 X |
| 3,441,084 | 4/1969 | Fredd | 166/250 |
| 3,454,084 | 7/1969 | Sizer | 166/344 X |
| 3,601,190 | 8/1971 | Mott | 166/322 X |
| 3,625,281 | 12/1971 | Herd | 166/344 |
| 3,675,720 | 7/1972 | Sizer | 166/322 X |
| 3,680,637 | 8/1972 | Raulins | 166/313 |
| 3,696,868 | 10/1972 | Taylor | 166/315 |
| 3,771,603 | 11/1973 | Crowe | 166/72 |

OTHER PUBLICATIONS

Composite Catalog 1968-1969, p. 3825.

*Primary Examiner*—Ernest R. Purser

*Attorney, Agent, or Firm*—Vinson & Elkins

[57] ABSTRACT

A method of and apparatus for treating or completing wells to provide surface controlled subsurface safety systems in the wells, whether at the time of original completion or when the well is reworked or re-equipped. A method and apparatus is provided for installing receptacles at the upper ends of one or more lower well flow conductors left in place in the well below the surface for receiving the lower ends of corresponding upper flow conductor sections having surface controlled subsurface safety valves connected therein for controlling undesired flow from the well through said lower flow conductors in the event of an emergency, disaster or accident damaging the surface flow controlling system or threatening the integrity thereof. A hanger or packer may be installed in the well casing below the surface for supporting the upper ends of the lower flow conductor or conductors therebelow and providing means for connecting receptacles at the upper ends of said lower flow conductors above such hanger or packer. The upper flow conductors having the flow controlling safety valves mounted therein may then be installed in the well in flow communication with the receptacles and the tubing strings or flow conductors therebelow. The upper flow conductor sections may have concentric or laterally offset parallel flow control fluid conduits communicating therewith for controlling actuation of the safety valves from the surface of the well. Also, conductor line means is provided for conducting fluids from above the hanger or packer at the upper end of the lower flow conductor to the annulus in the well casing therebelow for gas lift or for injection into the well producing formation, as desired.

5 Claims, 20 Drawing Figures

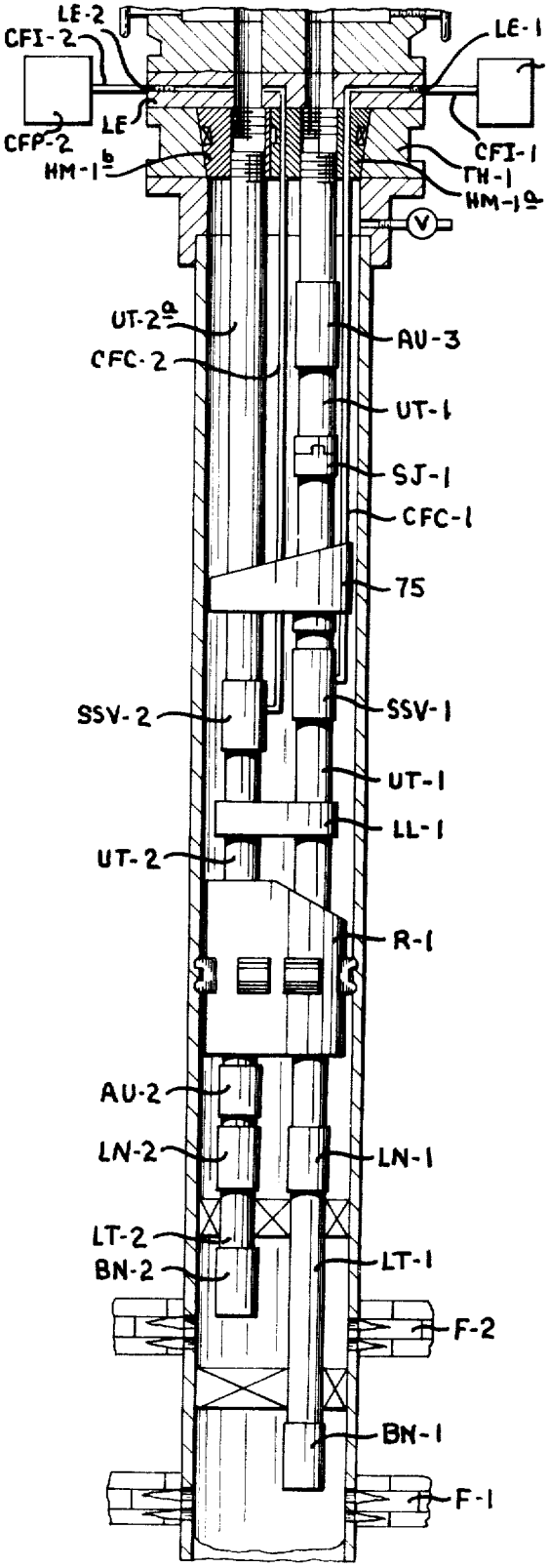
FIG. 7
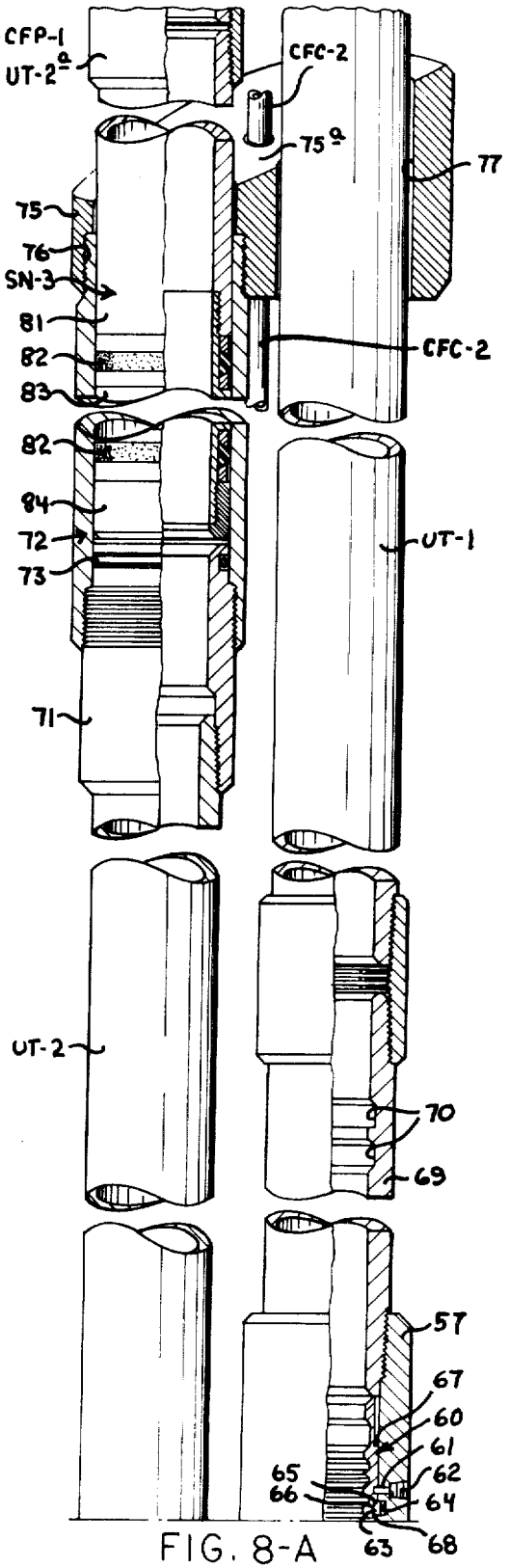
FIG. 8-A

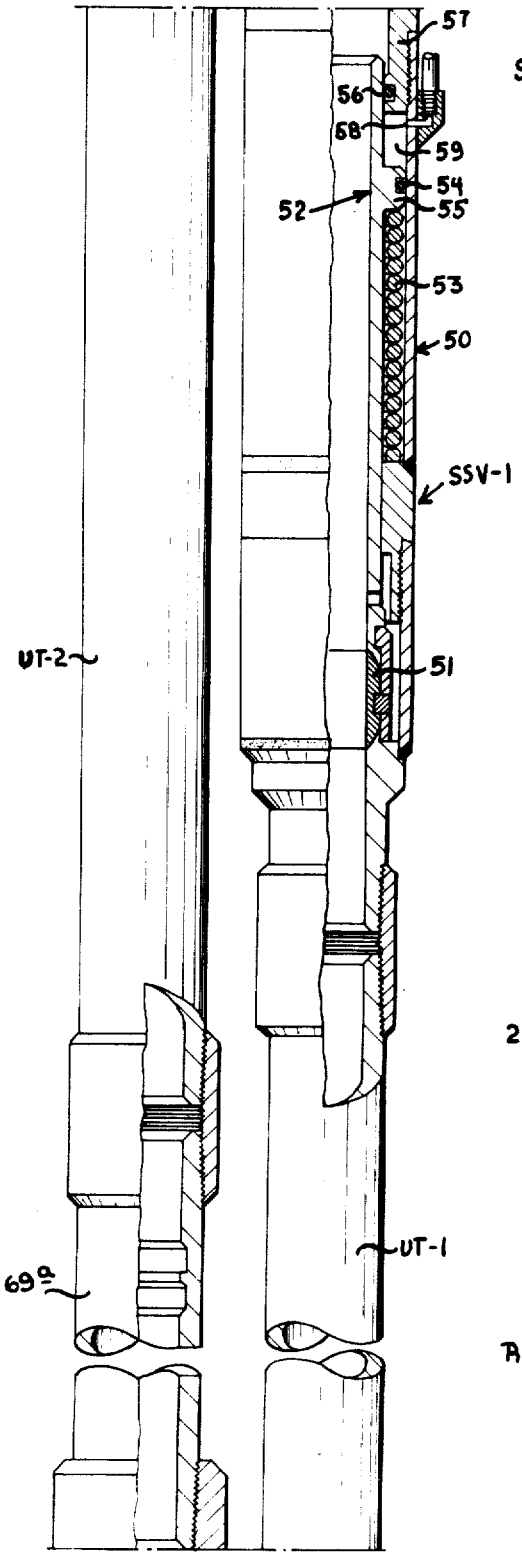
FIG. 8-B
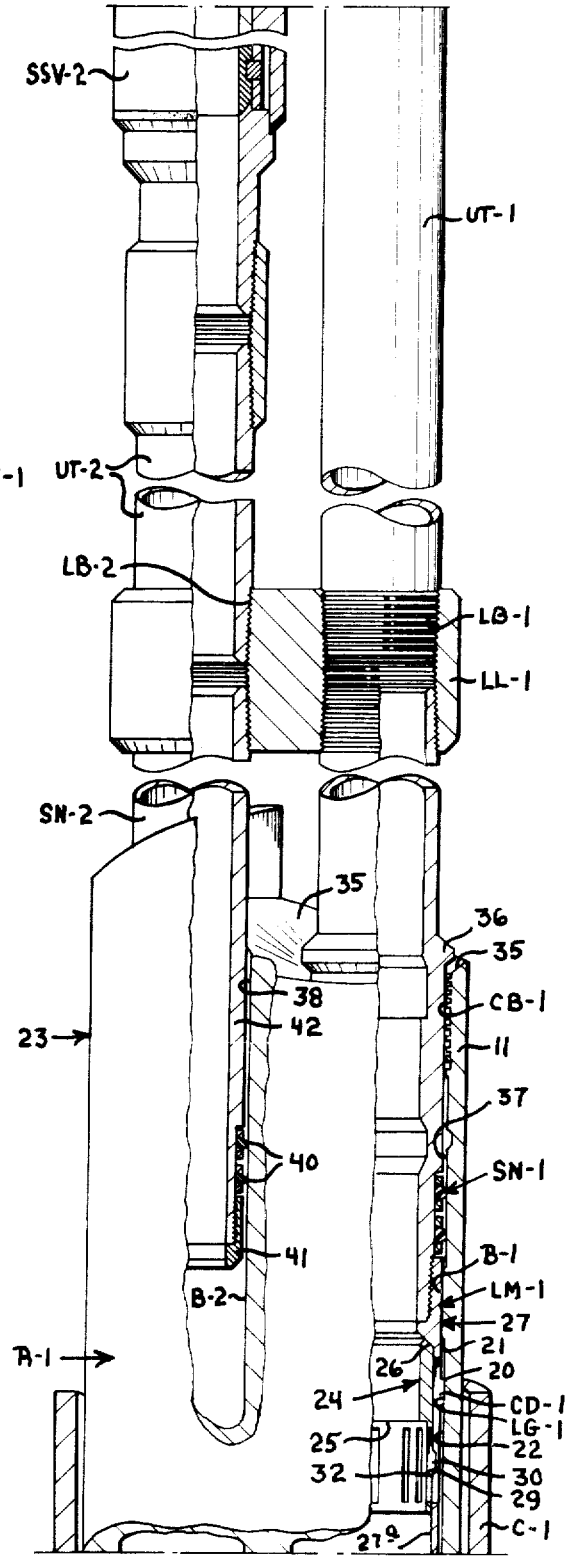
FIG. 8-C

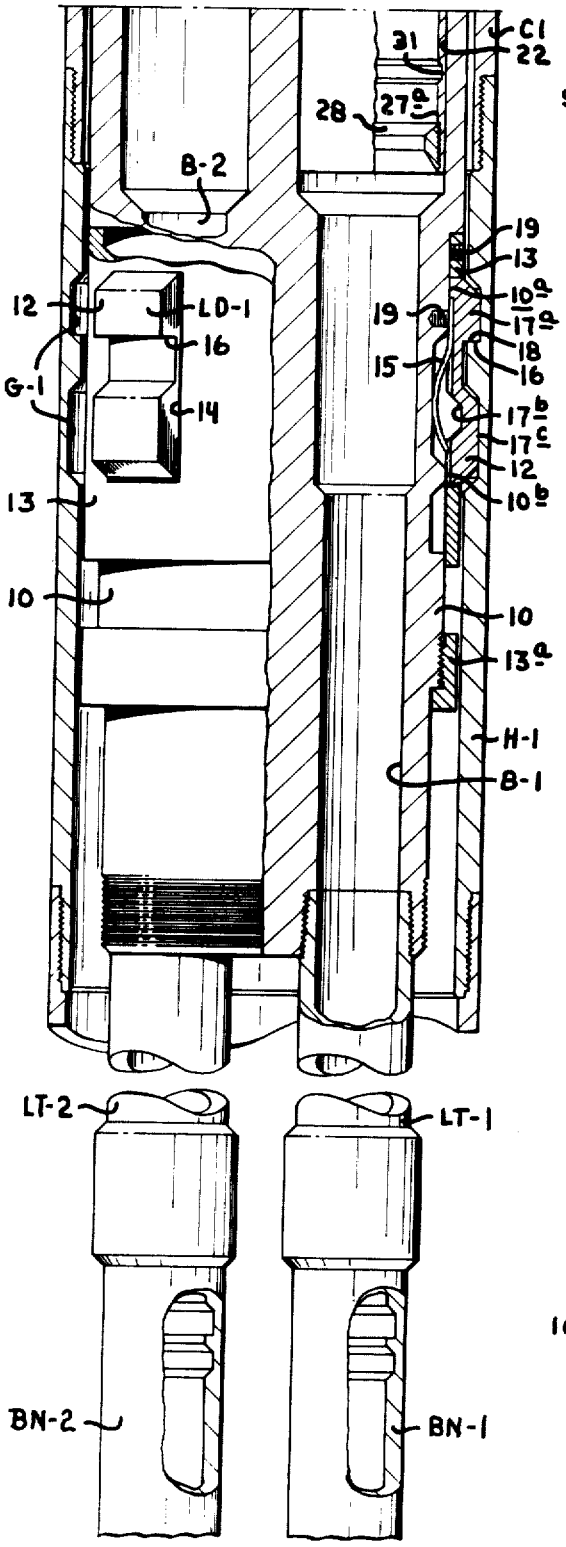
FIG. 8-D
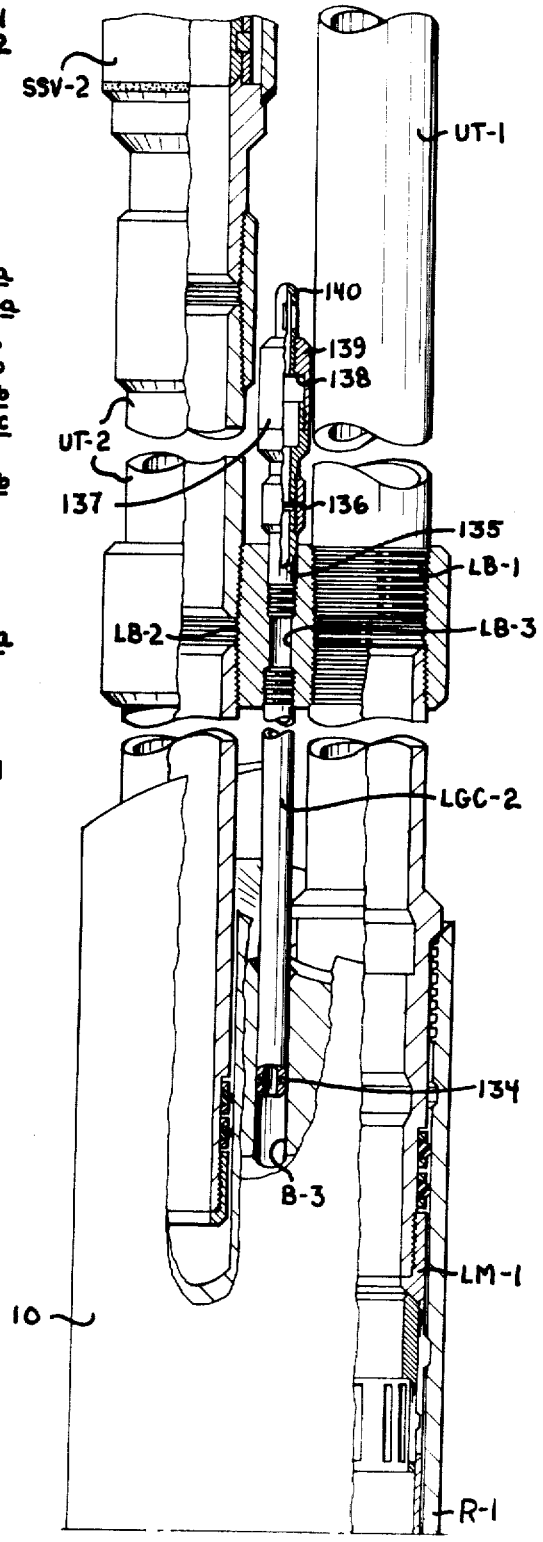
FIG. 13-A

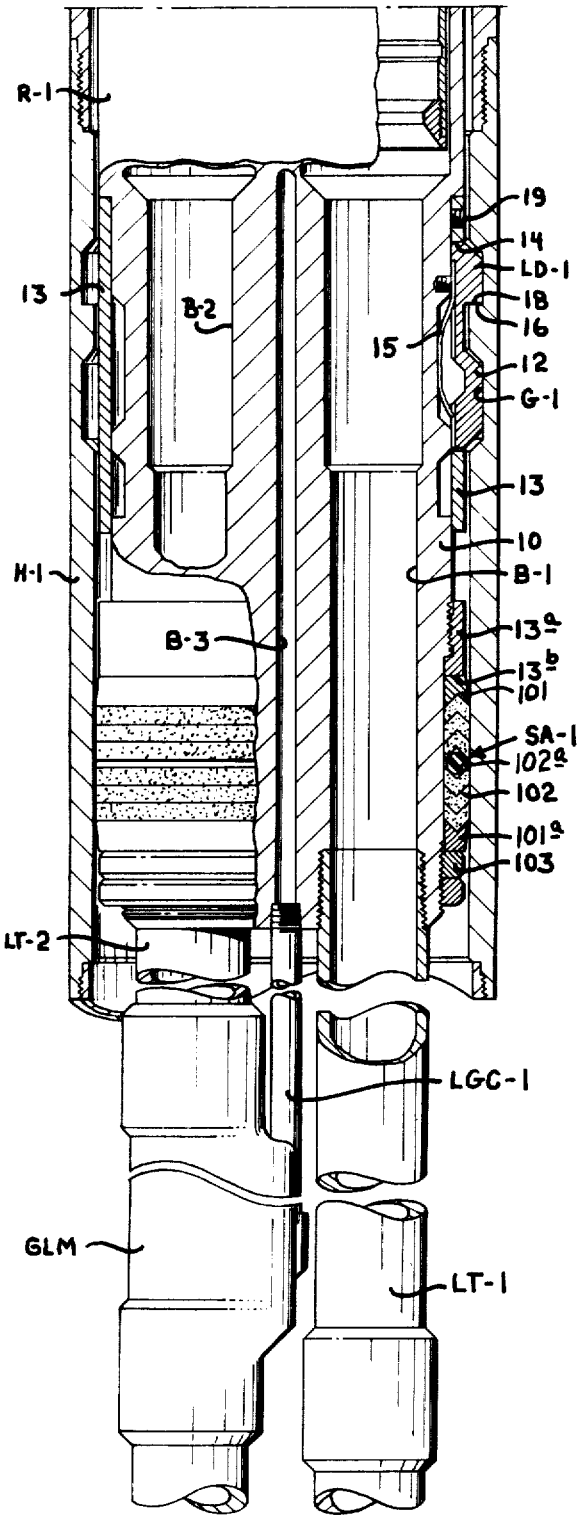
FIG. 13-B
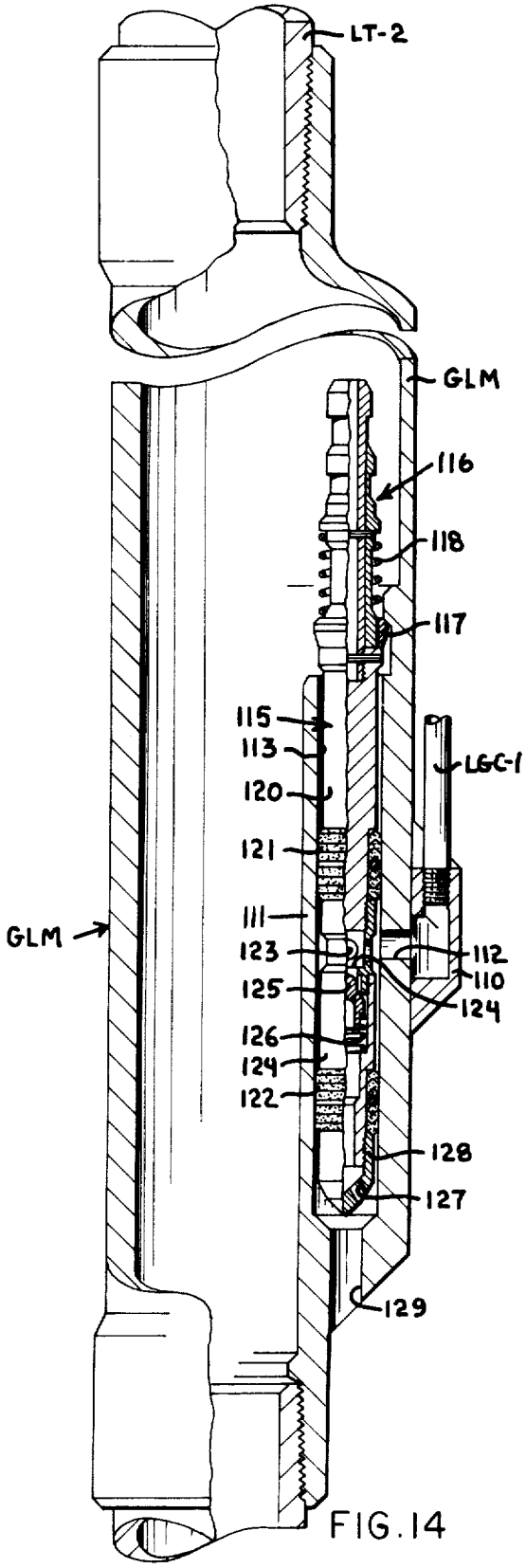
FIG. 14

PLURAL PARALLEL TUBING WITH SAFETY JOINTS OR RELEASE FROM SUSPENDED RECEPTACLE

This application is a division of our copending application Ser. No. 270,977 filed July 12, 1972 and now U.S. Pat. No. 4,143,712 for APPARATUS FOR TREATING OR COMPLETING WELLS.

SUBJECT MATTER, BACKGROUND AND OBJECTS OF THE INVENTION

This invention relates to new and useful improvements in methods of and apparatus for treating or completing and operating wells, either when the well is initially completed or when the well is completely reworked, and for treating the well after completion, if desired.

Heretofore, in installations in which an upper tubing section was removably connected to the upper end of a lower flow conductor left in place in a well and wherein a safety valve was run into the well on such upper tubing section, each of such upper flow conductor sections was separately installed and anchored in flow communicating connection with the upper end of a selected one of the lower tubing strings or flow conductors and was separately disconnectable therefrom and separately removable.

In addition, separate overshot connectors were carried on the lower end of each of the upper tubing sections and telescoped over the upper ends of the lower flow conductors left in place in the well and supported by spiders or overshot hangers anchored in the well casing below the upper ends of such lower flow conductors; and separate guide strings extending from the surface into the upper ends of each such lower flow conductor were required to direct the overshot connector into telescoping engagement over the projecting upper end of each such lower flow conductor for latching the upper tubing section and safety valve connected therewith in flow communication to the lower flow conductor. Also, in each case the control fluid conduit or conduits controlling actuation of the safety valves were each run into the well with the separate upper tubing section containing the safety valve to be controlled by means of such conduit. Thus, in prior installations, the upper tubing sections having the safety valves connected therein and control fluid conduits connected therewith were each separately installed and anchored to the upper end of a selected lower flow conductor supported in the casing below the surface of the well so that several trips and manipulative operations were required to complete the installation and ready the well for production.

In some of the prior types of installations, there was danger of disturbing the packers and the flow conductors in the well while effecting the installation and installing and removing the safety valves and upper tubing sections. In addition, in the past, there has been no provision of means for conducting lifting gas or treating fluid downwardly past a check valve and through a packer of such an installation nor for controlling flow into the annulus below a packer past a check valve which is wire line retrievable through the one of the flow conductors or tubing strings in which it is positioned for controlling the flow of lifting gas or treating fluid into the annulus exteriorly of the tubing string.

It is, therefore, one object of the invention to provide a new and improved method of and apparatus for treating and completing wells, either upon original installation or upon reworking, to provide surface controlled subsurface safety valves in the conductor or conductors of the well below the surface for closing off the flow from the well in the event of damage to the surface connections.

A further object is to provide such improved method and apparatus which is particularly adapted for use during initial completion of the wells or for use in reworking wells during recompletion.

A particular object of the invention is to provide a method of and apparatus for installing receptacles in a well in or above a packer or a hanger for receiving the lower ends of one or more upper flow conductor sections in flow communications with the well flow conductors extending downwardly in the well below the upper packer or hanger, and wherein the upper flow conductor sections may be installed in such receptacles without the necessity of separately running and pulling guide strings and the like.

An important object of the invention is to provide means for running multiple strings of upper flow conductor sections in multiple-zone wells in which the safety valve for each of the lower flow conductors is run at the same time as all other of the safety valves of the multiple flow conductors.

Another object of the invention is to provide a method and apparatus of the character described wherein the control fluid conduits for controlling actuation of the surface controlled subsurface safety valves may be run simultaneously with the safety valves or separately installed at a subsequent time.

A further object of the invention is to provide a method and apparatus of the character just described wherein the safety valves and the flow conductors may be run in by a single one of the upper flow conductor sections and the additional upper flow conductor sections run separately into the well and anchored in a scoop head landing nipple or receptacle connected with the safety valves therebelow already in place in the well, whereby each of the upper flow conductor sections may be installed separately so as not to require unusual or extra heavy duty equipment and without the necessity of running guide strings or the like.

A still further object of the invention is to provide a method and apparatus of the character described wherein the control fluid conduits for conducting control fluid from the surface to the safety valves anchored in place in the well may be installed in such a manner that one control fluid conduit may be operable to control all safety valves or separate control fluid conduits may be installed to provide individual control for each of the safety valves and wherein such safety valves may be separately or simultaneously controlled from the surface.

Still another object of the invention is to provide an apparatus for and method of injecting lifting gas or treating fluids through a well packer and/or hanger in an installation of the character described for use in gas lifting fluids from the well or for treating the producing formations, and in which the flow path of the injected lifting gas or treating fluid through the hanger and/or packer is separate from the flow conductors extending therethrough.

A further important object of the invention is to provide in an apparatus and method of the character just described one or more check valves in the injected fluid flow path through the packer for controlling back-flow of the injected fluids from the annulus below the packer through such injected fluid flow path to the annulus above the packer, and further wherein at least one of such check valves is removable through one of the upper flow conductors sections for service, repair or replacement without otherwise disturbing the installation.

A further object of the invention is to provide in a check valve installation of the character described, means for closing off the flow path for the injected lifting gas or treating fluid when the removable back flow check valve is removed from the flow path in which it is normally installed and operable.

Additional objects and advantages of the invention will be readily apparent from the reading of the following description of a device constructed in accordance with the invention, and reference to the accompanying drawings thereof, wherein:

FIG. 7 is a schematic view of the completed well installation in condition for operation of the well;

Figure 11:
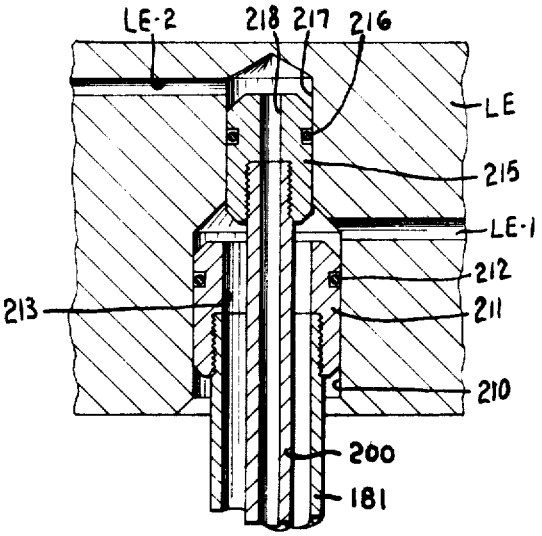
Figure 9:
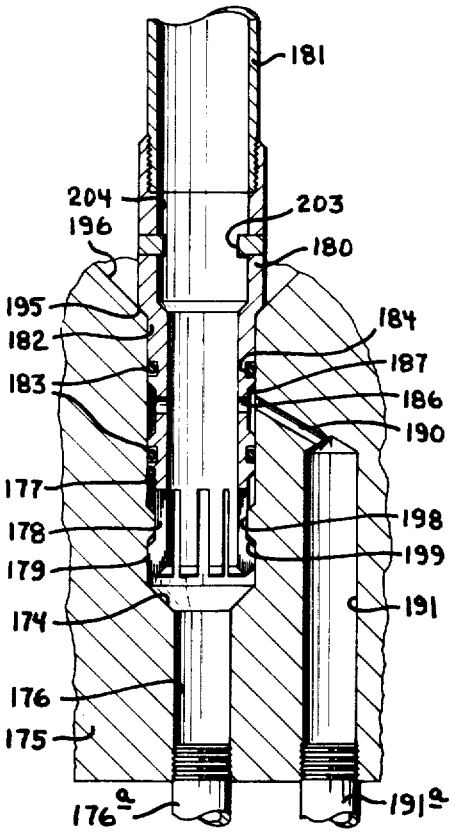
Figure 10:
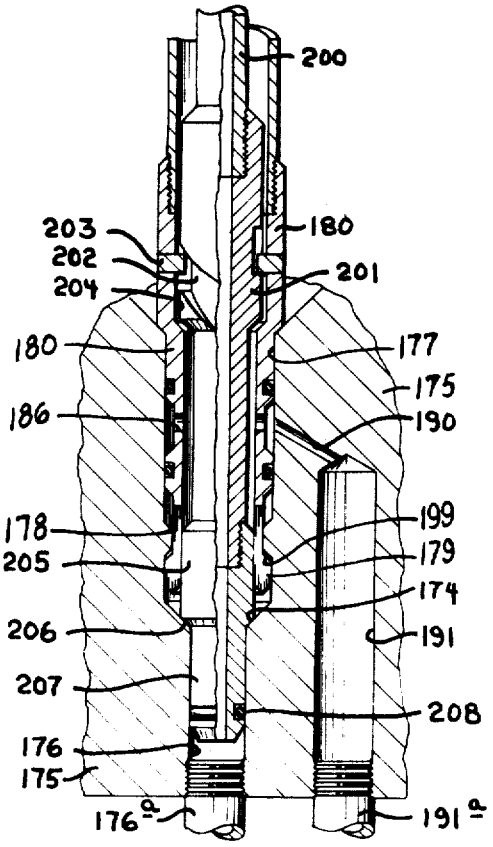
Figure 16:
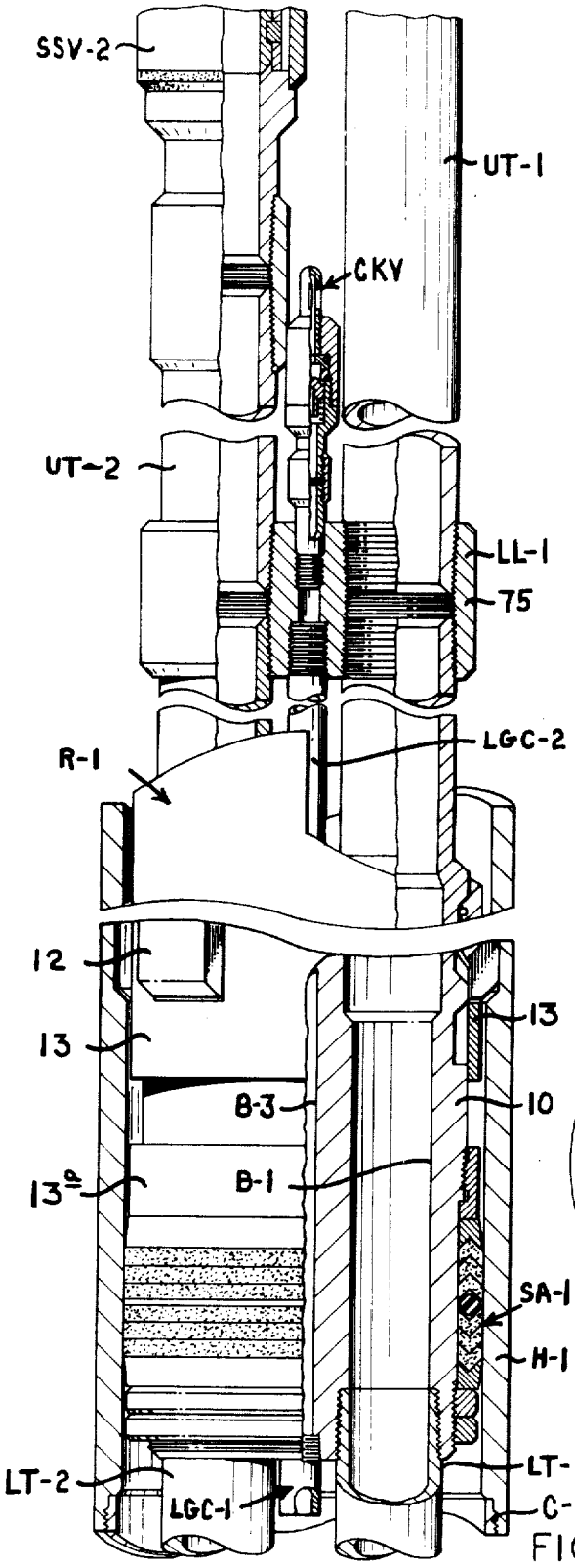
Figure 15:
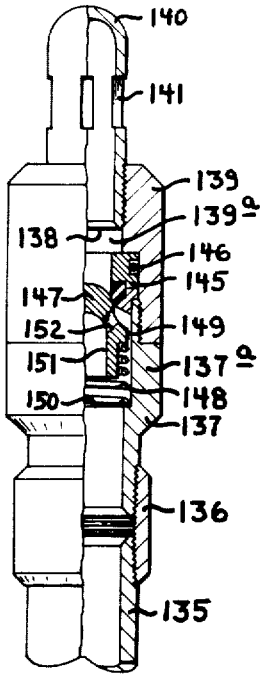
Figure 12:
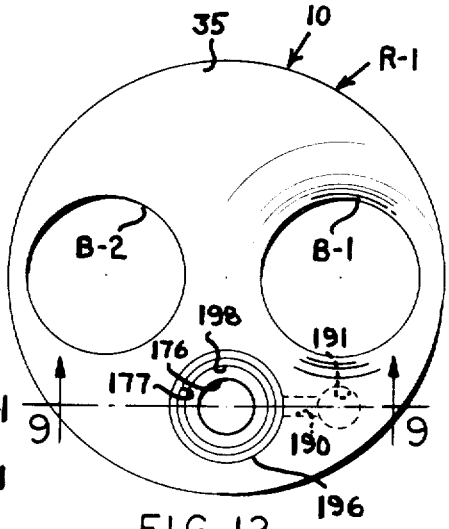

FIGS. 8-A, 8-B, 8-C, and 8-D are enlarged detailed views, partly in elevation and partly in section, of the guide head, safety valves, and latch head, and showing the latching member locked in the casing hanger of the installation of FIG. 7;

FIG. 9 is a fragmentary vertical longitudinal sectional view taken on the line 9—9 of FIG. 12 showing a single control fluid conduit in place in the guide head;

FIG. 10 is a fragmentary vertical sectional view similar to FIG. 9 showing a multiple control fluid conduit secured in the guide head of FIG. 12;

FIG. 11 is a fragmentary vertical sectional view of the upper end of the multiple control fluid conduits of FIG. 10 showing one manner in which they may be positioned and sealed in the well head of the installation;

FIG. 12 is a horizontal cross-sectional view of a modified form of the guide head of FIG. 7, showing means for connecting control fluid conduits to the guide heads installable independently of the upper tubing sections;

FIGS. 13-A and 13-B are enlarged detailed views, partly in elevation and partly in section, of a packer used for supporting and sealing off between the lower flow conductors and the well casing and providing a third flow path through the packer to an offset mandrel receptacle in one of the flow conductors below the packer for controlling admission of lifting gas or treating fluids injected through the packer into the annulus therebelow;

FIG. 14 is an enlarged fragmentary view, partly in elevation and partly in section, of the offset mandrel receptacle and a removable check valve installed therein for controlling injected fluids flowing through the third flow path of FIGS. 13-A and 13-B;

FIG. 15 is an enlarged view, partly in elevation and partly in section of a nonremovable check valve which may be utilized in the installations of FIG. 13-A and FIG. 16, if desired, and, FIG. 16 is a view similar to FIGS. 13-A and 13-B showing a third flow conductor establishing the flow path through the packer terminating immediately below the packer.

Figure 1:
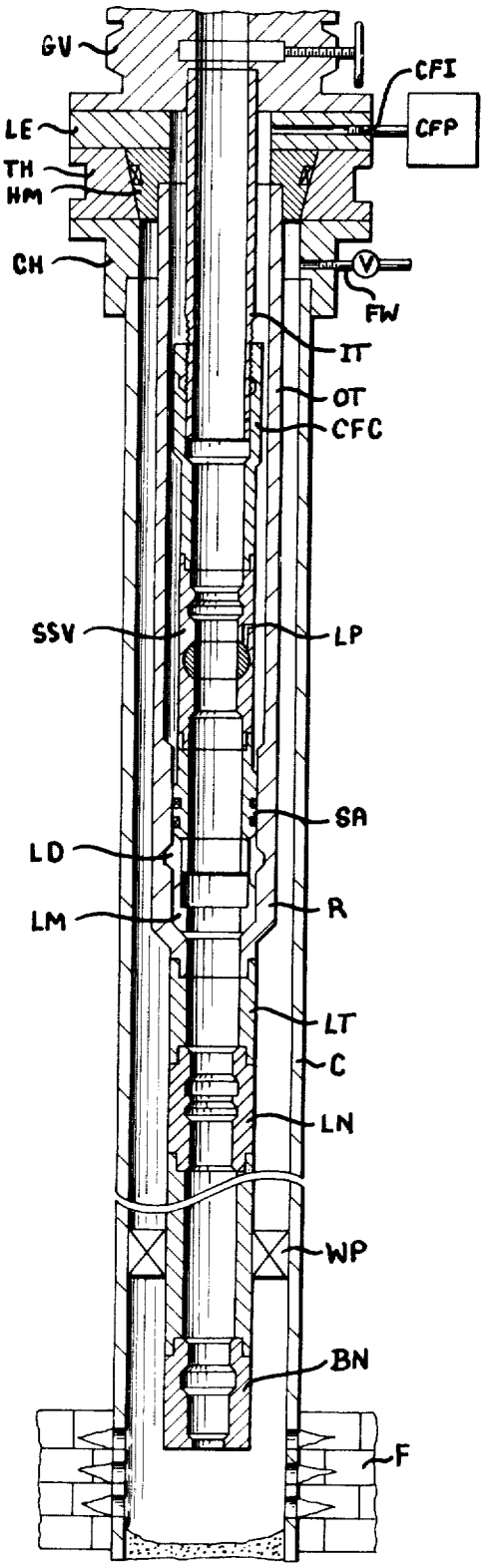
FIG. 1 is a schematic view of a well installation embodying the method and apparatus of the invention in a system for controlling flow from a single zone well.
Figure 2:
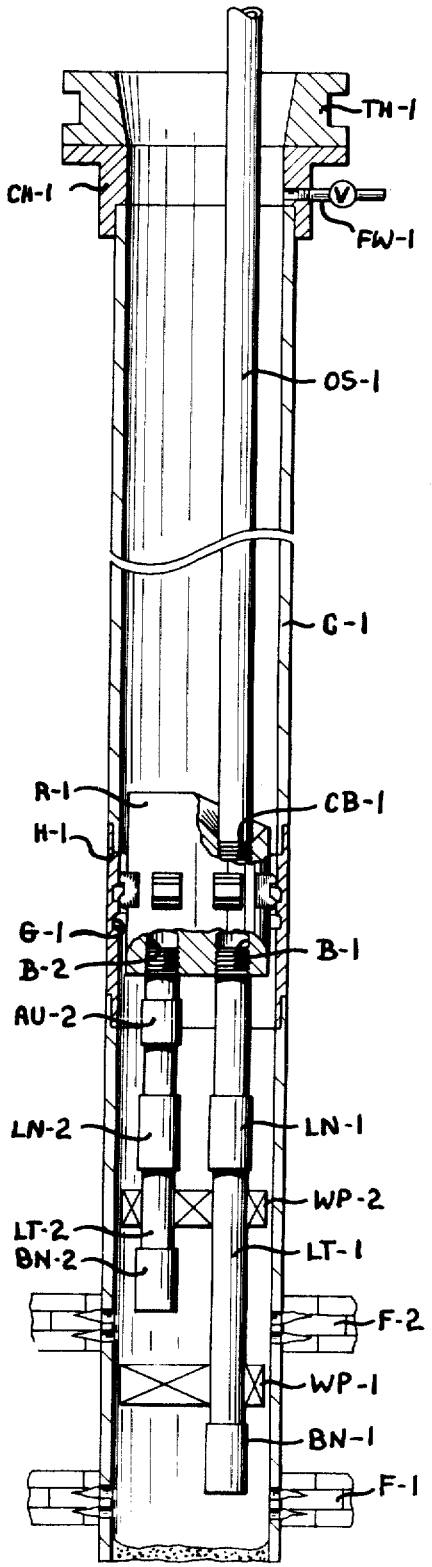
FIG. 2 is a schematic illustration of a multiple-zone well in which the apparatus for carrying out the method is shown in the first stage of being installed in the well for completing the system wherein a casing hanger is shown being lowered by means of an operating string into a landing nipple for supporting the lower flow conductor strings in the casing.

In FIG. 1 of the drawings a well installation utilizing the apparatus and method of the invention is shown for controlling flow from a single zone well. A well casing C extends from the surface downwardly to a point adjacent or below the producing formation F and has at its upper end a casing head CH to which the upper end of the string of casing C is connected. The casing head supports a tubing head TH which has a hanger member HM seated therein in sealing relationship and supporting the upper end of an outer flow conductor or tubing string OT.

The outer tubing string OT has a receptacle or housing R connected therein at a predetermined point below the surface of the well which is threadedly connected in said outer tubing string and has its lower end connected to a lower tubing string or flow conductor LT which extends downwardly to a well packer WP sealing between the lower tubing string LT and the well casing C above the producing formation F. A landing nipple LN is connected in the lower tubing string LT below the receptacle R for a purpose to be hereinafter more fully described. A similar landing nipple BN is connected near the lower end of the lower tubing string and provides means for seating a plug therein adjacent the producing formation. The landing nipple LN also provides means for seating a plug or closing tool for closing the bore of the lower tubing string LT below and adjacent the receptacle R, as will be more fully explained.

The usual gate valve GV is connected to a bushing or flange LE connected between the tubing head TH, and the gate valve, and the bushing is provided with a lateral flow inlet CFI for control fluid introduced into the outer tubing string OT from a source of control fluid pressure CFP at the surface for a purpose to be hereinafter described.

An upper inner tubing string IT has a surface controlled subsurface safety valve SSV connected therein near its lower end, and below the safety valve is a latching mechanism LM which is provided with locking dogs or the like LD for securing the lower end of the inner tubing string IT in the bore of the receptacle R in flow communication with the bore of the lower tubing string LT below the receptacle. A seal assembly SA forms a part of the locking mechanism and seals between the locking mechanism and the bore of the receptacle R for directing all fluid flow from the lower tubing string LT through the latching mechanism and the safety valve SSV to the bore of the inner tubing string IT and to the gate valve GV thereabove at the surface. The bore of the upper inner tubing string IT, and the bore of the surface control subsurface safety valve SSV and the bore of the latch mechanism LM are all substantially equal to the bore of the lower tubing string LT below the receptacle R. The bore of the landing nipple LN also is substantially full opening, while the bore of the bottom landing nipple BN may have a restriction and seat therein if desired. Thus, a plug or closing tool (not shown) may be lowered through the upper inner tubing string IT, the safety valve SSV and the latching mechanism LM to the landing nipple LN to be seated in said landing nipple below the receptacle R to close off access of flow of fluid and pressure from the producing formation F to the bore of the tubing strings LT and IT thereabove, and from the safety valve SSV and latching mechanism LM, whereby the fluid pressure may be relieved from the bores of the tubing strings and safety valve and latching mechanism above the plug to permit ready removal of the upper inner tubing string IT and the safety valve and latching mechanism from the well after releasing the locking mechanism LM. The upper inner tubing string and the safety valve and latching mechanism are then removable by lifting the upper inner tubing string IT out of the well. This permits removal of the safety valve and latching mechanism for service, repair, or replacement thereof.

The surface controlled subsurface safety valve SSV has a lateral port LP which admits control fluid pressure from the annular space between the upper inner tubing string IT and the bore wall of the upper portion of the outer tubing string OT, where control fluid from the control fluid pressure source CFP entering through the control fluid inlet opening CFI in the bushing LE may pass downwardly through such annular space to the port in the safety valve to control actuation of the safety valve in the usual manner. A valve suitable for such actuation is shown in the patent application of Donald F. Taylor, Ser. No. 99,534, filed Dec. 18, 1970 now U.S. Pat. No. 3,696,868.

The receptacle R is made up in the outer tubing string OT when the string is inserted in the well, and located in sealing engagement with the well packer WP which also seals with the wall of the casing above the lower producing formation F. The outer tubing string is hung from the tubing head TH in the usual manner and the well is completed for controlling flow therefrom by plugging the bore of the outer tubing string OT in the landing nipple LN then lowering the upper inner tubing string IT and surface controlled subsurface safety valve SSV and latching mechanism LM into the well to anchor the latching mechanism in the receptacle R and secure the lower end of the inner tubing string IT in sealed flow communication with the bore of the lower tubing string LT below the receptacle.

The usual wellhead fittings are connected to the upper end of the flow conductor and the gate valve GV to provide the usual well Christmas tree or flow control system for controlling flow from the well then controlled in the usual manner.

The safety valve is then tested by moving it between open and closed positions by raising and lowering the control fluid pressure acting thereon through the lateral port LP. And the wellhead fittings and other equipment may be pressure tested for leaks. After the testing has been completed, a suitable retrieving mechanism, such as a wireline or mechanical operated type pulling tool is lowered through the inner tubing string IT and through the bore of the safety valve and latching mechanism into the landing nipple LN to engage the plug located therein to release the same and remove it from the landing nipple and lift it upwardly through the lower tubing string LT, the latching mechanism LM, the safety valve SSV and the upper inner tubing string IT to the surface. After the plug and retrieving mechanism have been removed, the well is in condition for production of well fluids therefrom.

During production, the subsurface safety valve SSV will be normally held in open position by the application of an adequate predetermined control fluid pressure conducted thereto from the control fluid pressure source CFP through the annular conduit CFC formed between the outer tubing string OT and the inner tubing string IT. Should a condition occur in the flow conductor in the well above the safety valve, or at the well surface, which would create a need to close the safety valve, the pressure of the control fluid may be reduced to permit the safety valve to move to closed position in the usual manner. If desired, suitable sensing mechanisms and relief valves or pilot valves may be connected in in the control fluid lines CFI to release or reduce the pressure of the control fluid in the control fluid conduit CFC to permit the valve to move automatically to the closed position upon the occurrence of such an event. When the safety valve SSV is closed in this manner, and any flow from the well producing formation F upwardly through the tubing string LT and the tubing string IT to the surface is prevented.

Obviously, when it is desired to remove the subsurface safety valve SSV or any of the other tools connected as a part of the upper inner tubing string IT, the well plug or closing tool (not shown) may be lowered through the inner upper tubing string and through the safety valve and latching mechanism LM into the landing nipple LN and anchored therein in sealed flow preventing position. After the plug has been installed, pressure may be relieved from the bore of the upper inner tubing string IT and the bore of the safety valve SSV and latching mechanism LM and, at the same time, from the bore or the outer tubing string OT, whereupon the inner tubing string IT, the safety valve and the latching mechanism may be lifted from the outer tubing string OT without difficulty since there is no well pressure present in the upper outer tubing string OT above the plug or in the bore of the receptacle R. This facilitates the removal and re-installation of the safety valve, latching mechanism, and inner tubing string IT in the manner already described. Obviously, when the safety valve or latching mechanism has been repaired or replaced or otherwise serviced, the inner tubing string IT having the safety valve and the latching mechanism connected therewith may be reinserted through the outer tubing string OT and the latching mechanism LM locked in the receptacle R, after which the plugging tool may be removed from the landing nipple LN through the bore of the latching mechanism, the safety valve and the inner tubing string IT, as has been explained. The usual well connections at the upper end of the well are then installed and the well is again in condition for production therefrom.

It will therefore be seen that an apparatus, system and method has been disclosed for treating or completing wells to provide a surface controlled subsurface flow controlling device therein which may be readily installed and removed and replaced when desired. Also, it will be seen that the system provides for a control fluid conduit formed between concentric tubular members leading from the surface to the safety valve for controlling actuation of the safety valve thereof by control fluid pressure conducted thereto through such conduit from the surface. Also, the valve mechanism may be removed without communicating the well producing formation with the bore of the tubing string above the plug and without communicating the formation with the casing annulus, during the time the safety valve and its associated parts are removed, or while they are being inserted or removed.

Figure 3:
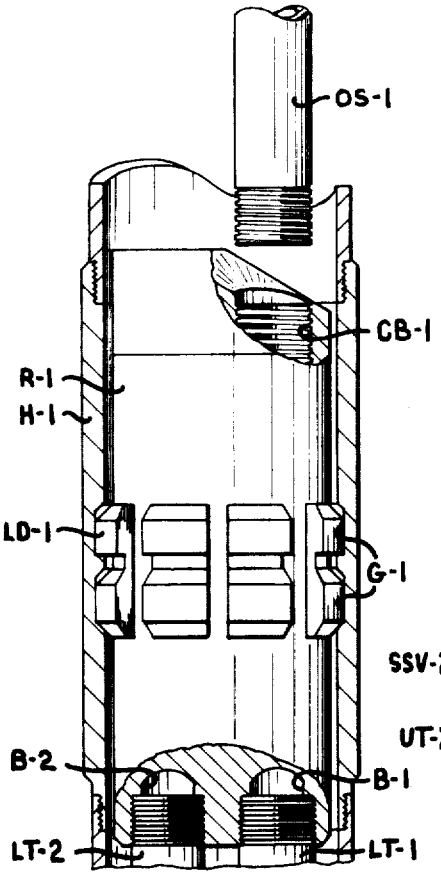
FIG. 3 is an enlarged fragmentary schematic view showing the casing hanger seated in the landing nipple and the operating string disconnected therefrom.
Figure 4:
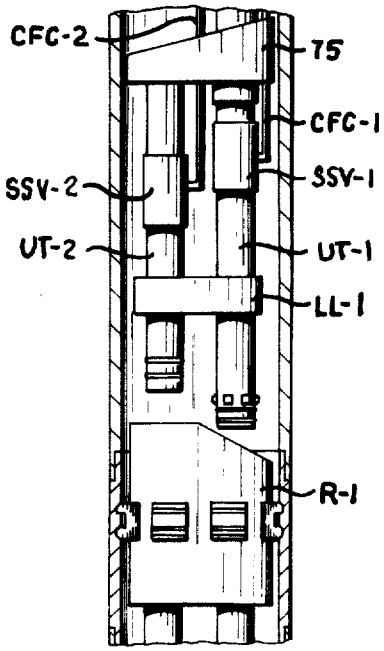
FIG. 4 is a fragmentary view of the well installation of FIG. 3 showing the latch head, safety valves and guide head connected to the lower end of one of the upper tubing sections and being lowered into place in the casing hanger.
Figure 5:
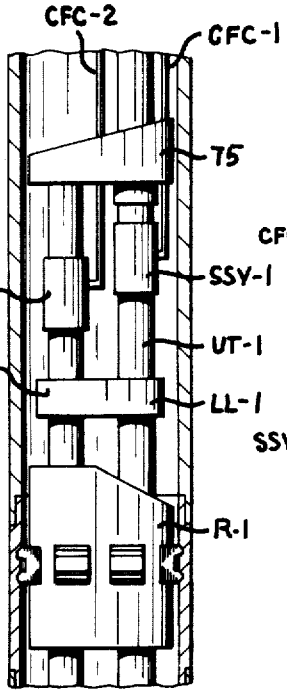
FIG. 5 is a view similar to FIG. 4 showing the latch head, safety valves and guide head locked in place in the casing hanger in flow communication with the lower flow conductors therebelow.
Figure 6:
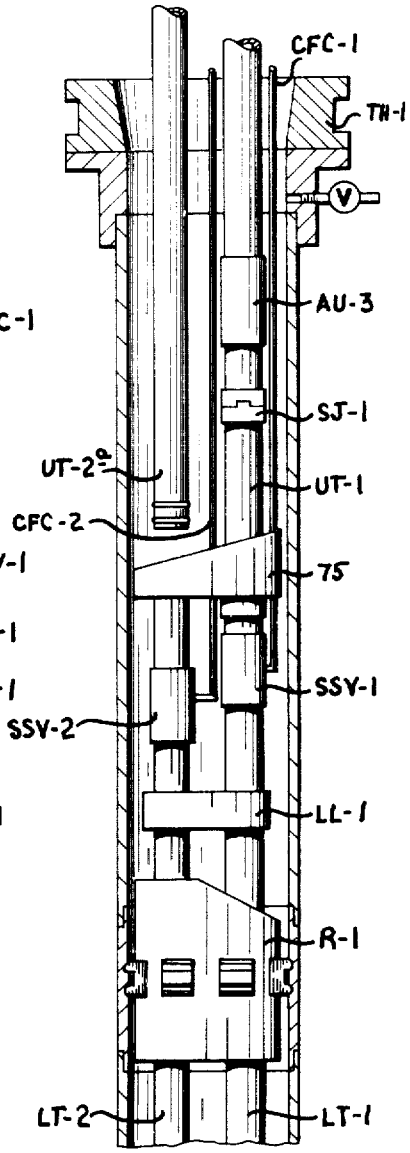
FIG. 6 is a view similar to FIG. 5 showing a second upper flow conductor section being lowered into place in the guide head preparatory to completing the installation.

A modified form of the invention and the well installation is shown in FIGS. 2 through 7, inclusive. In this installation a well casing C-1 is installed in the usual manner with a casing head CH-1 at its upper end at the surface of the well. Above the casing head is a tubing head TH-1 also of the usual type. A lateral flow wing FW-1 having a control valve V therein is connected to the side opening of the casing head and provides means for entry and exit of fluids into the bore of the casing from the exterior thereof. The casing has a receptacle receiving and supporting housing H-1 connected therein below the surface and provided with locating and locking grooves G-1 in its base. The casing extends downwardly from the housing through at least two producing formations F-1 and F-2 therebelow. The usual perforations communicate the producing formation with the bore of the casing at each of the formations. A lower packer WP-1 is designed to be anchored in sealing position in the bore of the casing between the formation F-1 and the formation F-2, and to seal between the casing and a long string of lower tubing LT-1 and the casing. An upper well packer WP-2 is designed to be anchored in sealing position in the bore of the casing above the upper formation F-2, and seal between the casing wall and the lower long string tubing LT-1 and a short string of lower tubing LT-2. A bottom landing nipple BN-1 is connected to the lower end of the long lower tubing string LT-1 and a similar landing nipple BN-2 is connected to the lower end of the short lower tubing string LT-2. The landing nipples are similar or identical to the landing nipple BN of the form first described. A receptacle member R-1 in the form of a removable hanger is designed to be anchored in the housing H-1 by locking dogs LD-1 engaging in the grooves G-1 in the housing H-1 forming a part of the casing C-1. The receptacle member R-1 thus may be supported and anchored against movement in the casing string within within the housing. An adjustable union AU-2 is connected in the lower tubing string LT-2 below the receptacle member R-1 and provides means for making up the lower tubing string LT-2 to the receptacle after the longer lower tubing string LT-1 has been connected thereto. This permits the lower tubing string to be adjusted in length between the upper packer WP-2 and the receptacle R-1 to accommodate the locking dogs LD-1 to the grooves G-1 in the housing H-1 when the packers WP-1 and WP-2 are anchored in place in the well, so as to equalize the lengths of the lower tubing strings LT-1 and LT-2 between the receptacle member R-1 and the upper packer WP-2. Plug landing nipples LN-1 and LN-2 are connected in the lower tubing strings LT-1 and LT-2, respectively, for receiving plugging tools in the same manner as the landing nipple LN of the form first described. The tubing strings LT-1 and LT-2 are connected in the lower end of two bores B-1 and B-2, respectively, which extend through the receptacle member R-1, as shown in FIG. 3, and are open at their upper ends at the upper ends of the receptacle.

The receptacle member R-1 and the packers and lower tubing strings connected therewith are lowered into the well casing C-1 by means of an operating string OS-1 which has a connection shown to be a left hand quick release thread on its lower end threaded into a complementary threaded bore CB-1 in the upper end of the bore B-1 of the receptacle member. When the packers WP-1 and WP-2 have been set and the receptacle member anchored in place in the housing H-1, the running in string or operating string OS-1 is disconnected by turning the same to the right to unscrew it from the threads CB-1 in the bore B-1 of the receptacle member, and the operating string is then removed from the well casing. The installation is then in condition to receive the safety valves and upper tubing strings for controlling flow in the well.

An upper tubing string flow conductor UT-1 has a latch member LM-1 connected to its lower end below a guide head GH-1 and a locator head LL-1, all shown in detail in FIGS. 8-A through 8-D.

The receptacle R-1 has a cylindrical mandrel or body 10 through which the two side-by-side bores B-1 and B-2 extend. The body has a head 11 provided with a guide surface 35 at its upper end. The locking dogs LD-1 are in the form of selective keys 12 carried in slots 14 in a cage 13 and movable radially laterally outwardly and inwardly through the slots. A spring 15 biases each dog outwardly of the slots 14 to engage the wall of the casing, and when the receptacle has been lowered into the housing H-1 the keys will be biased outwardly by means of the springs into the selective grooves G-1 conforming to the exterior boss configuration of the locking dogs, so that the downwardly facing abrupt shoulder 16 in the lower end of the upper boss 17*a* of the locking dogs or keys engages the upwardly facing shoulder 18 in the grooves and further downward movement of the dogs is halted. Downward force on the body or mandrel 10 then shears a shear screw 19 extending through the wall of the cage 13 into a threaded recess in the mandrel, whereupon the mandrel is permitted to move further downwardly with respect to the locking dogs until the enlarged external locking surface 10*a* on the mandrel is engaged between the inner surfaces of the upper bosses 17*a* of the dogs to positively hold the dogs outwardly in engagement in the recess. An external annular flange 10*b* on the mandrel spaced below the locking surface 10*a* registers with a recess 17*b* in the inner surface of the lower bosses 17*c* of the locking dogs to permit the dogs to retract when the cage is secured in its lower position on the mandrel by the shear screw 19. When the shear screw is sheared and the mandrel moved downwardly with respect to the cage 13 and the locking dogs LD-1, the flange 10*b* engages the inner surface of each of the lower bosses 17*c* of the keys 12 simultaneously with the engagement of the locking surface 10*a* with the inner surface of the upper bosses 17*a*, and the keys are thus positively held outwardly in locking engagement in the recess G-1 in the housing H-1, and so support the receptacle R-1 and the well equipment connected therewith against undesired downward movement in the casing. The locator head LL-1 has a pair of threaded bores LB-1 and LB-2 extending therethrough adapted to receive the upper end of the latching mechanism LM-1 and the upper end of a seal nipple SN-2, respectively. The latching mechanism LM-1 also is provided with a sealing assembly SN-1 and locking collet dogs CD-1 which are resiliently biased outwardly into position to engage beneath a locking shoulder 21 at the upper end of an enlarge bore 22 in the upper portion of the bore B-1 of the receptacle member R-1. The collet locking dogs CD-1 are positively held in expanded position in the enlarged bore 22 below the shoulder 21 by a locking sleeve 24 which is slidable in the bore of the latching member LM-1 from a position below the collet fingers of the collet dogs to the position shown in FIG. 8-C by a commonly commercial available shifting tool (not shown) which engages the downwardly facing shoulder 25 in the bore of the locking sleeve 24 for moving the sleeve upwardly. The upper end of the locking sleeve engages a downwardly facing stop shoulder 26 in the bore 27*a* of the body 27 of the latching LM1 when the sleeve is moved to its upper position. Initially, the locking sleeve 24 is supported on an upwardly facing stop shoulder 28 in the lower portion of the bore 27*a* of the latching member LM-1, and the above has collet detent fingers 29 provided with external bosses 30 thereon which engage in detent grooves 31 and 32, respectively, adjacent the lower and upper shoulders 28 and 26, respectively. The engagement of the bosses in the detent grooves yieldably restrains the locking sleeve 24 in either the lower position engaging the stop shoulder 28 or in the upper position engaging the stop shoulder 26. The shifting tool for shifting the sleeve is similar to that illustrated in the application of Phillip S. Sizer and Carter R. Young, Ser. No. 210,727, filed Dec. 22, 1971 now U.S. Pat. No. 3,848,668, for shifting the locking sleeve to the upper locking position. Similarly, the downshifting tool shown in the aforesaid application may be used for shifting the sleeve downwardly in the same manner as in that application.

As shown in FIG. 8-C the latching mechanism LM-1 is anchored in the bore B-1 of the head 23 of the receptacle member R-1 with the sealing assembly SN-1 sealing against the bore wall of the bore of the receptacle. As shown in that figure, the upper end of the head 23 of the receptacle member is dished to provide an inclined concave guide surface 35 which extends downwardly from a point above the bore B-2 in head of the receptacle member to a point surrounding the upper open end of the bore B-1 in the head member. The bore B-1, as will be seen, in somewhat larger than the bore B-2 of the head member and has the left hand threads CB-1 therein for connecting the same to the operating string OS-1. The bore beneath the threads provides a sealing surface 37 above the locking shoulder 21 in the upper end of the enlarged bore 22 therebelow. The dished or beveled guide surface 35 directs the lower end of the latching member LM-1 into the bore B-1 in the head of the receptacle member, the larger diameter of the latching member preventing the latching member from entering the smaller bore B-2 in the head, and an external annular stop flange 36 on the upper portion of the latching mechanism LM-1 engages the upwardly facing surface 35 surrounding the bore B-1 to limit downward movement of the latching mechanism. When the latching mechanism enters the bore B-1, the seal nipple SN-2 which is connected to the lower end of the latch head LL-1 and which does not extend downwardly as far as does the latching member, is disposed to be movable with the latch head LL-1 and the latching member LM-1 downwardly in the smaller bore B-2 in the head 23 of the receptacle member. The sealing nipple SN-2 has a plurality of seal elements 40 on its reduced diameter lower end held in place thereon by a retaining bushing 41 for sealing between the mandrel 42 of the seal nipple SN-2 and the bore wall sealing surface 38 of the bore B-2 in the head of the receptacle. The latch head LL-1 positively positions and moves the sealing nipple SN-2 with the latching member LM-1 as the two members are moved into the bores in the head of the receptacle member as just described.

Above the locator head LL-1 a long upper string of tubing UT-1 is connected. The string of tubing UT-1 has connected therein a surface controlled subsurface safety valve SSV-1, which may be of the type illustrated and described in the application of Donald F. Taylor, Ser. No. 99,534, filed Dec. 18, 1970. The safety valve includes a housing 50 having a rotatable ball member 51 therein movable between the open position shown in FIG. 8-B to a closed position (not shown) by an actuating mechanism including an elongate operating sleeve 52. A helical coil spring 53 biases the actuating sleeve upwardly in the housing 50 for rotating the ball toward closed position. An external annular seal ring 54 on an enlarged annular flange 55 on the operating sleeve 52 serves as a poston for moving the operating sleeve downwardly by control fluid pressure to move the ball to the open position shown in FIG. 8-B. An internal seal ring 56 is disposed in an internal annular groove in a bushing 57 forming the upper portion of the housing, and a lateral inlet port 58 for control fluid extends inwardly through the side wall of the housing 50 for conducting control fluid into the chamber 59 between the seal members 56 and 54.

The operating sleeve 52 may be positively locked in a lower position holding the ball valve 51 completely open by a shiftable locking sleeve member 60 which is normally held in an inactive position as shown in FIG. 8-A, by a shear pin or screw 61 threaded through the side wall of the bushing 57 and sealed to prevent admission of fluid through the threaded opening therein as by a tapered threaded plug 62. A snap ring or locking ring 63 is disposed in an internal annular groove 64 in the bore of the bushing 57 and has a beveled upper inner edge 65 which engages a similarly beveled downwardly facing shoulder 66 on the lower outer end portion of the locking sleeve 60 for camming the locking ring outwardly into the recess 64 to permit the sleeve to move downwardly therepast. An upwardly facing abrupt lock shoulder 67 is formed on the upper outer portion of the locking sleeve 60 and engages the lower planar surface or end 68 of the locking ring when the sleeve is moved downwardly to engage the upper end of the operating sleeve 52 of the valve. The locking ring thus positively holds the locking sleeve 60 in its lower position, locking the operating sleeve 52 in its lower position, with the ball valve positively held in the open position shown in FIG. 8-B, in the manner explained in the foregoing application of Taylor, Ser. No. 99,534.

The tubing string UT-1 above the safety valve is provided with a landing nipple 69 having internal annular stop and locking grooves 70 formed therein for receiving other tools, as also explained in the aforesaid Taylor patent application.

The lower end of the short tubing string UT-2 is threadedly engaged in the threaded bore LB-2 of the locator head LL-1 and extends upwardly th efrom. The upper tubing string UT-2 is also provided with a surface controlled surface safety valve SSv-2, which may be exactly like the safety valve SSV-1 connected in the lower upper tubing string UT-1. Since these safety valves are larger in diameter than the upper tubing strings of which they are a part, it may be desirable or even necessary to stagger their positions longitudinally in the well casing so that they will not be in side-by-side relationship when installed, so they will readily fit in the well casing.

The short upper tubing string UT-2 above the safety valve SSV-2 is provided with a landing nipple 69a, which may be identical to the landing nipple 69 in the tubing string UT-1, having internal annular stop and lock grooves 70a therein for receiving other well tools, as in the case of landing nipple 69.

A bushing 71 is threaded onto the upper end of the short upper tubing string UT-2, and the upper end of the bushing is threaded into the lower end of an elongate tubular sealing sleeve 72; a seal ring 73 between the bushing and the sealing sleeve prevents fluid leakage through the threads. The upper end of the sealing sleeve 72 is threaded into the lower end of one bore 76 of the guide head 75, and so connects the short upper tubing string UT-2 to the guide head, thus connecting the guide head to the locator head LL-1. The long upper tubing string UT-1 extends through a smaller unthreaded bore 77 in the guide head and upwardly thereabove to a safety joint SJ-1 of the usual type, which is connected in the customary manner in the longer upper string UT-1. Similarly, an adjustable union AU-3 is connected in the long string UT-1 above the safety joint and just below the tubing hanger HM-1 in the tubing head TH-1 for adjusting the length of the upper tubing string UT-1 and so correctly positioning the hanger member HM-1*a* in the bowl of the tubing head in the usual and customary manner. When the upper tubing string UT-1 has been lowered into the well to position the latching member LM-1 in the bore B-1 of the head member 23 of the receptacle member R-1, and the sealing nipple SN-2 in the bore B-2 of the head member 23, the open upper end of the bore 76 at the upper end of the guide head 75 is positioned to receive a seal nipple SN-3 connected to the lower end of a short upper tubing string UT-2*a* which is lowered into the casing by means of said tubing string UT-2*a* until the lower end of the seal nipple engages the upper inclined concave guide surface 75a of the guide head and is guided thereby into the bore of the seal sleeve 72 connected in the bore 76 in the guide head. The seal nipple SN-3 has a tubular mandrel 81 with a plurality of sets of seal rings 82 secured on the exterior of the reduced opposite ends of a packing spacer sleeve 83 threaded at one end into the lower end of the bore of the mandrel 81 and having a retaining nut or bushing 84 threaded onto its other end. The beveled lower end of the retaining nut 84 will engage the inclined surface 75a on the guide head to direct the lower end of the upper tubing string UT-2*a* into the bore 76 of the sleeve 75.

As is shown in FIG. 7, the upper end of the upper tubing string UT-2*a* is connected in the usual manner to the hanger member HM-1*b* which is similar to hanger member HM-1*a* and constitutes the other half of a split hanger having seal members between the sections and seal members on their exterior sealing with the bowl of the tubing head TH-1. An exit flange LE having lateral control fluid inlets LE-1 and LE-2 is connected to the upper end of the tubing head TH-1 and a control fluid conduit CFI-1 is connected at one end to the control fluid inlet LE-1 and at the other end to the control fluid pressure supply CFP-1 for directing control fluid from the supply into the well and through the control fluid conductor line CFC-1 to the safety valve SSV-1 to control the operation of the safety valve. Similarly, a second control fluid conduit CFI-2 is connected at one end to the control fluid inlet LE-1 and to a control fluid pressure supply CFP-2 to direct control fluid through a second conduit CFC-2 to the second safety valve SSV-2 for controlling operation of the safety valve. Obviously, if desired, the control fluid inlet conduit CFI-1 may communicate directly with the annulus between the casing C-1 and the tubing strings UT-1 and UT-2*a* and UT-2 and enter the lateral port 58 of each safety valve to act on the piston 55 on the actuating sleeve 52 to control actuation of the ball valve 51 of each safety valve, in the manner already described. However, it is believed preferable to extend the small control fluid conductor line CFC-1 to the safety valve SSV-1 on the long string UT-1 and a separate control fluid conductor line CFC-2 to the safety valve SSV-2 connected in the short string UT-2 below the guide head 75. These conductors may be in the form of small diameter pipes or flexible tubing, both supported by the long string of tubing UT-1 and lowered therewith simultaneously into the well.

It is readily apparent that, if desired, a plug may be lowered through each of the tubing strings UT-2*a* and UT-2 and the tubing string UT-1 into the landing nipples LN-2 and LN-1, respectively, in the lower tubing strings LT-2 and LT-1 below the receptacle and below the safety valves SSV-2 and SSV-1, whereby the upper tubing string UT-2*a* may be removed from sealing engagement in the seal nipple or sleeve 72 connected to the guide head 75. The long upper tubing string UT-1 may then be lifted to lift the guide head, the two safety valves SSV-1 and SSV-2 and the latch head LL-1 with respect to the receptacle member R-1 after the latching member LM-1 has been released from locking engagement with the head 23 of the receptacle member to permit such upward movement. The locking sleeve 24 of the latching member is moved downwardly below the collet locking dogs CD-1 in the latching member and, when the long upper tubing string UT-1 is lifted, the collet spring fingers will bend or flex inwardly to permit the bosses 20 on the spring fingers of the collet dogs CD-1 to pass the stop shoulder 21 and the latching member to be withdrawn from the bore B-1 of the head 23 of the receptacle member R-1. Similarly, the seal nipple SN-2 will slide upwardly out of the bore B-2 and the entire assembly above the receptacle member R-1 may thus be lifted from the well without communicating the two producing formations through the tubing strings LT-1 and LT-2 below the receptacle member since plugs are disposed in the landing nipples LN-1 and LN-2. The pressure within the casing above the receptacle member and above the upper packer may then be completely reduced or reduced to any desired degree to permit safe removal of the assembly without working under pressure.

It will be seen that the plugging tool may be lowered through the bores of the tubing strings through the safety valves and the latching members and seal nipples in the landing nipples LN-1 and LN-2 in the same manner as in the form first described. Similarly, when the safety valves and latching members and seal members have been repaired, replaced or otherwise serviced, the assembly may again be lowered into the casing until the latching member enters the bore B-1 and the seal member SN-2 enters the bore B-2 of the head 23 of the receptacle member R-1. The lock sleeve 24 of the latching member is then lifted by the upward shifting tool into the position shown in FIG. 8-C, to positively lock the collet dogs CD-1 in locking position with the bosses 20 thereon disposed to engage the downwardly facing lock shoulder 21 in the bore B-1 of the head member to anchor the assembly in place. The long upper tubing string UT-1 may then be connected to its section HM-1*a* of the tubing hanger and the short upper tubing string UT-2*a* connected to its hanger section HM-1*b* and lowered into the casing until the lower end of the seal nipple SN-3 is directed by the guide surface 75*a* of the guide head 75 into the seal sleeve 72 connected to the upper end of the short string of upper tubing UT-2. After the hanger members HM-1*a* and HM-1*b* have been seated in the tubing head TH-1, and the other well fittings connected, the plugging tools (not shown) may be withdrawn from the landing nipples LN-1 and LN-2 through the latching member, the seal nipples, and the safety valves, leaving the respective upper tubing strings connected to the lower tubing strings LT-1 and LT-2. When the plugs are removed, of course, the fluids from the well producing zones which are in flow communication with the lower ends of the tubing strings LT-1 and LT-2 will flow upwardly through those tubing strings to the upper tubing strings UT-1 and UT-2 and UT-2*a* connected with such lower tubing strings to the well surface and from the well through flow lines (not shown), in the usual manner.

The safety valves will then be operable by means of control fluid from the control fluid pressure source or sources acting on the pistons 55 on the actuating sleeves 52 of the safety valves to open the valves to permit such flow. Should any condition arise in the well flow conductors or at the surface of the well which is sensed by any desired suitable sensing device, or should it be desired to actuate the safety valves intentionally, the pressure of the control fluid conducted through the control fluid conductors to the safety valves may be reduced to permit the coil spring 53 in each of the valves to move the actuating sleeve 52 upwardly to rotate the ball closure member 51 to the closed position.

Each of the safety valves SSV-1 and SSV-2 has the same structure as the other and the same numbers have been applied to the parts thereof where shown.

From the foregoing, it will be seen that a well completion apparatus has been illustrated and described which permits installation, servicing and removal of the surface controlled subsurface safety valves in the well. As shown in the forms of the device illustrated in FIGS. 2 through 8-D, the well is a dual zone well. Obviously, more than two strings of pipe may be supported in the casing communicating with more than two producing formations in the usual well-known manner. Also, it is believed readily apparent that the control fluid may be directed into the bore of the casing exteriorly of the several tubing strings to act on the safety valves SSV-1, SSV-2, and the like, connected in such strings simultaneously, if desired. Or, a separate control fluid conduit may be run into the well simultaneously with the long string of tubing UT-1 and each control fluid conduit connected with a separate single one of the subsurface safety valves. Also, at the surface the control fluid conduits may be connected to a single source of control fluid pressure or to separate sources of control fluid pressure for simultaneous or separate actuation and control of the operation of the valves.

Obviously, if desired, a control fluid conduit in the form of two concentric pipes may extend downwardly from the tubing head and the hanger member, in the bore of the casing exteriorly of the tubing strings, to enter a longitudinal control fluid passage from which separate short conductor pipes may extend to the lateral inlet ports 58 of the separate safety valves. Such an arrangement is shown in FIG. 9, wherein a guide head 175 is provided with a bore or control fluid passage 176 which communicates by means of a pipe 176*a* with one of the safety valves SSV-1 or SSV-2. The passage 176 is enlarged in its upper portion to provide a seal surface 177 for receiving a seal nipple 180 on the lower end of a control fluid conductor 181. Spring collet fingers 178 having external bosses 179 thereon extend downwardly from the lower end of the seal mandrel 182 of the seal nipple 180 and a plurality of O-rings 183 are mounted in longitudinally spaced external annular recesses 184 on the mandrel on opposite sides of a lateral flow port or ports 186 communicating with an external annular groove 187 of the mandrel between the O-rings. A lateral passage 190 is formed in the guide head 175 communicating at one end with the enlarged bore 177 at a point between the O-rings 183 on the seal nipple 180 and at the other end with a second control fluid passage 191 extending downwardly parallel to the control fluid passage 176 which is connected by means of a pipe 191*a* to the other of the subsurface safety valves SSV-2 or SSV-1. The enlarged bore 177 in the passage 176 is flared at its upper end for guiding the lower end of the seal nipple 180 into the passage, and a shoulder 195 on the nipple above the uppermost O-ring 183 engages and seats against the flared surface 196 to stop downward movement of the seal nipple and position the lateral ports 186 in communication with the lateral passage 190 and the seal O-rings 183 on opposite sides of such lateral passage. In addition, the lower portion of the enlarged bore 177 of the passage 176 has an internal annular flange 198 which is convergently beveled at its upper and lower ends, and the lower beveled end provides a retain-shoulder 199 against which the bosses 179 of the collet fingers 178 engage to retain the seal nipple 180 in the bore 177. Of course, the collet finger bosses may spring inwardly to pass the beveled opposite ends of the internal flange 198 when it is desired to move the control fluid conduit 181 from the position shown in FIG. 9. The control fluid conduit 181 and seal nipple 180 of the form just described provide for simultaneous control of the two safety valves by control fluid pressure conducted through the conduit 181 to the bores 176 and 191 in the guide head, from which the fluid is conducted to the two safety valves SSV-1 and SSV-2 so that the control of the safety valves will be simultaneous.

To provide separate control fluid conduits for individual control of each of the two safety valves, as shown in FIGS. 10 and 11, an inner control fluid conduit 200 in the form of a tubular pipe has a mandrel 201 at its lower end provided with a J-slot lock 202 which engages a J-lock pin 203 in the enlarged bore 204 of the seal nipple 180 for positively locking the inner control fluid conduit 200 to the seal nipple 180 when the inner control fluid conduit is rotated to engage the lock slot 202 with the pin 203. The lower end of the mandrel 201 of the inner control fluid conduit has an enlarged body 205 threaded onto it and provided with an external annular beveled stop shoulder 206 which engages the beveled seat 174 at the lower end of the enlarged bore 177 of the guide head. A seal nose member 207 has an external annular recess near its lower end in which an O-ring 208 is positioned for sealing between the seal nose 207 and the bore wall of the bore 176. When the J-slot 202 is engaged with the pin 203 the enlarged body 205 on the lower end of the mandrel 201 is disposed within the collet fingers 178 on the lower end of the seal nipple 180 to hold the same in expanded position and prevent their bosses 179 from being displaced from position to engage the retaining shoulder 199 in the bore 176 of the guide head. Thus, control fluid pressure passing downwardly through the control fluid conduit 200 will pass downwardly through the mandrel 201, the body 205 and the nose 207, and outwardly below the seal ring 208 into the conductor pipe **176*a* leading to one of the subsurface safety valves. Control fluid pressure from a separate source passing downwardly in the bore of the control fluid conduit 181 exteriorly of the control fluid conduit 200 will pass outwardly through the lateral ports 186 in the seal nipple 180 and through the lateral passage 190 to the passage 191 and the pipe 191*a*** to the other subsurface safety valve for controlling actuation of that valve.

As shown in FIG. 1, the upper ends of the inner control fluid conduit 200 and the outer control fluid conduit 181 are connected separately to tubular packing or sealing heads 211 and 215 adapted to be disposed in bores 210 and 216 in the exit flange LE at the well head. The larger lower vertical bore 210 formed in the exit flange is open at its lower end and receives the tubular enlarged packing or sealing head 211 threaded onto the upper end of the outer control fluid conduit 181, and an O-ring sealing member 212 in an external annular groove on said sealing head 211 seals with the bore 210 below the lateral control fluid inlet conduit LE-1. Control fluid from the control fluid pressure source CFP-1 (FIG. 1) conducted to the larger bore 210 through the inlet line CFI-1 is directed through the bore 213 of the sealing head 211 into the annular spaced between the outer control fluid conduit 181 and the exterior of the inner control fluid conduit 200.

The inner control conduit 200 has the smaller tubular sealing head 215 threaded onto its upper end. An external annular sealing O-ring 216 in an external annular groove on the head 215 engages a reduced upper bore 217 above the upper end of the bore 210 in the exit flange LE and the bore 218 of the head 215 communicates with the bore 217 above the head. The control fluid inlet LE-2 extending into the exit flange LE conducts control fluid pressure from the source of control fluid pressure CFP-2 through the control fluid inlet line CFI-2 to the upper reduced bore 217, and downwardly through the bore 218 in the seal head 215, the inner control fluid 200, the bore of the mandrel 201, and the nose 207 to the bore 176 in the guide head 175, and thence through the control fluid conductor **176*a* leading downwardly to the one of the subsurface safety valves with which the conductor 176*a*** is connected.

Thus each of the conduits conducts fluid from the separate control fluid pressure sources CFP-1 and CFP-2 through the separate conduits 181 and 200 to the separate safety valves SSV-1 and SSV-2. Therefore each of the safety valves may be separately and independently controlled, and the control fluid conduits may be installed independently of the installation of the upper tubing strings UT-1, UT-2, and the like, after the guide head has been positioned in the bore of the casing.

In some installations it will be desirable to inject a lifting fluid or gas into the casing bore exteriorly of the upper tubing strings UT-1, and UT-2 and UT-2*a*, above the receptacle R-1 to provide for lifting well fluids from one or both of the producting formations below the packers WP-1 or WP-2, as the case may be. In wells in which such an operation is to be carried out the receptacle member R-1 will be provided, as shown in FIGS. 13-A and 13-B, with a sealing assembly SA-1 which is mounted on the lower portion of the mandrel or body 10 of the receptacle member. The sealing assembly is confined on the reduced lower portion of the body below a retaining nut **13*a* which holds the sleeve 13 against downward displacement from the mandrel or body 10. The lower end of the retaining nut 13*a* provides a shoulder 13*b* against which a downwardly facing retaining ring 101 may abut to confine a plurality of packing rings 102 on the mandrel or body below the retaining ring 101, and above a similar upwardly facing retaining ring 101*a* confined on the body by a pair of locking nuts 103 threaded onto the lower end of the body below the packing and confining the packing in place on the body. The sealing members 102 of the sealing assembly SA-1 may be of the fluid pressure actuated type which are energized by fluid pressure in the well and may be directed in opposite directions and separated by an O-ring 102*a* to seal against pressures either above or below the receptacle, if desired. Of course, other types of packing assemblies may be secured in place on the reduced portion of the body 10 of the receptacle member R-1, if desired. As shown in FIG. 13-B, the sealing assembly SA-1 will seal against the bore wall of the housing H-1 below the grooves G-1 when the receptacle member is secured in the housing and locked in place therein by means of the locking dogs LD-1. As shown in FIGS. 8-A through 8-D, and FIGS. 13-A and 13-B, the bore of the housing member H-1 may be slightly restricted in diameter below the internal diameter of the casing to provide for reception of the sealing member therein in sealing position. Thus, when the receptacle R-1 is installed in the housing H-1, the sealing assembly SA-1 seals between the body or mandrel 10** of the receptacle R-1 and the bore wall of the housing H-1 to prevent fluid flow exteriorly therepast, and to direct all fluid flow through the bores B-1 and B-2 of the receptacle and the tubing strings connected therewith.

For conducting lifting gas or fluid from above the receptacle R-1 downwardly in the well casing to a gas lift valve GLV which is shown in FIG. 13-B and FIG. 14 to be positioned in an offset type gas lift landing nipple mandrel GLM, a lifting gas conduit or conductor LGC-1 is connected at its lower end to a side inlet boss 110 mounted on the exterior of the offset side pocket section 111 of the gas lift mandrel assembly GLM. Lifting gas conducted downwardly through the conduit LGC-1 to the side entrance or inlet 112 into the side pocket section 111 will flow through the side inlet into the bore 113 of the side pocket section 111 for the check valve assembly 115 releasably secured therein. The check valve assembly includes a locking mandrel 116 having the usual annular locking ring 117 vertically slidable thereon and biased downwardly toward locking position by a spring 118. A similar locking device is shown in the patent to Schramm, U.S. Pat. No. 3,207,224, issued Sept. 21, 1965, or the patent to McGowen, U.S. Pat. No. 3,074,485, issued Jan. 22, 1963. Carried by the locking mechanism is a cylindrical packing mandrel 120 having a solid upper section and a tubular lower section having a bore 124. Spaced sealing assemblies 121 and 122 are mounted on the exterior of the mandrel for sealing between the mandrel and the bore 113 of the side pocket section 111 above and below the lateral opening 112. Lifting fluid entering through the lateral opening will enter the lateral openings 123 in the side wall of the tubular lower portion of the mandrel between the sealing assemblies and flow downwardly in the bore 124 of the sealing mandrel past a check valve 125 which is resiliently biased toward closed position by a spring 126. The fluids will then flow outward through the openings 127 in the cap or nose member 128 at the lower end of the packing mandrel. Thus, lifting gas entering the side pocket mandrel from the lifting gas conductor LGC-1 through the side inlet 112 in the gas lift mandrel assembly GLM-1 will pass downwardly through the bore 124 of the packing mandrel 120 past the check valve therein, and then flow out through the openings 127 to a downward outlet opening 129 communicating with the lower end of the bore 113 of the side pocket section 111 and then downwardly in the bore of the casing below the receptacle member or hanger to enter the usual gas lift valves connected in the string of tubing therebelow for lifting the oil flowing upwardly from the producing formation communicating with the tubing string. As shown in FIG. 14, therefore, the valve assembly 115 provides a check valve in the injection line or lifting gas conductor LGC-1 to prevent backflow of fluids from the bore of the casing upwardly through said lifting gas conductor to a point above the packer or above the receptacle R-1. Above the receptacle member, a lifting gas conductor LGC-2 is connected to a third bore LB-3 extending longitudinally through the latching head LO-1 parallel to the tubing flow conducting openings LB-1 and LB-2 therein. The conductor LGC-2 is threaded into the lower end of the bore LB-3 and extends downwardly into a corresponding aligned bore B-3 formed in the receptacle member body 10 and extending downwardly longitudinally therethrough to the lower end thereof, and the upper end of the lifting gas conductor LGC-1 is threaded into the lower end of the base B-3, as shown in FIG. 12-B, so that the lifting gas conductor LGC-1 is lowered into the well along with the tubing strings LT-1 and LT-2 and the associated well equipment supported from the receptacle member R-1. When the upper tubing strings UT-1 and UT-2 and their associated well equipment are lowered into the tubing and the locking mechanism LM-1 is anchored in the bore B-1 of the receptacle R-1 the lower end of the upper lifting gas conductor LGC-2 enters the upper end of the bore B-3 and the seal ring 134 on the lower end of such conductor seals in the bore B-3. The bore LB-3 in the locator head LL-1 has a short nipple 135 threaded into its upper end and a coupling 136 connects the nipple to the lower end of a valve housing 137 having a valve seat shoulder 138 in the upper end of the upper section 139 of the housing and an entrance strainer head 140 threaded into the upper end of the bore 139*a* of the upper section above the seat 138.

The valve housing is shown in FIG. 13-A without any valve assembly located therein, but the fluids may enter through the openings 141 in the strainer head 140 to flow downwardly through the housing and the short nipple 135 to the bore LB-3 of the locator head and the lifting gas conductor LG-2 to the gas lift mandrel GLM below the receptacle member R-1. If desired, of course, a check valve closure member, such as is shown in FIG. 15, may be positioned in the bore of the housing 137. As shown, a tubular seat member 145 is mounted in the bore of the upper section 139 of the housing and confined between the upper end of the lower section 137*a* of the housing and the downwardly facing shoulder 138 in the upper section 139. An O-ring 146 seals between the seat ring and the bore wall of the upper housing section. A check valve closure member 147 is slidable in the bore of the lower section 137*a* of the housing section and is biased into engagement with the seat member 145 by a helical coil spring 148 confined between an external flange 149 on the valve closure member and an upwardly facing shoulder 150 in the bore of the lower housing section 137. A longitudinal counter bore 151 having a plurality of inclined lateral outlets 152 communicating therewith below the seating surface of the closure member provides for flow of fluids downwardly past the closure member when the closure member is in the open position, in the usual manner.

If desired, the provision of the side pocket gas lift mandrel assembly GLM and the check valve assembly 115 in the side pocket section 111 of the device shown in FIGS. 13-A, 13-B and 14, permits removal and replacement or repair of the check valve assembly 115 located in the gas lift mandrel GLM, so that the seats, the seals and the like may be changed when necessary without requiring that the entire well conductor installation be removed and replaced.

Of course, if desired, a check valve CKV of the character illustrated in FIG. 16 may be incorporated in the valve housing 137 of FIG. 13-A to operate in conjunction with the removable and replaceable side pocket check valve assembly 115 in the gas lift mandrel GLM, and this check valve would be effective in the absence of the removable check valve assembly 115 from the gas lift mandrel GLM. Of course, any fluids in the bore of the casing below the receptacle R-1 could enter through the bore 129 of the gas lift mandrel and flow upwardly in the tubing string LT-2 through the bore of the side pocket receptacle 113. However, the fluids could not flow upwardly in the annulus past the check valve CKV in the housing 137 above the locating head LL-1.

It is also believed to be apparent that, if desired, the gas lift mandrel GLM and the removable and replaceable check valve assembly CKV may be omitted from the installation. In such case, the lifting gas conduit LGC-1 extending downwardly below the receptacle R-1 could be cut off a short distance below the receptacle R-1, or eliminated if desired, in which event the fluids entering through the upper check valve CKV would flow downwardly through the check valve and the nipple 135 and the bore LB-3 of the locator head LL-1, and thence outwardly into the bore of the casing below the receptacle R-1 and the lifting gas conductor LGC-2 through the bore B-3 of the receptacle R-1 and into the bore of the casing below the receptacle. This type of installation would permit the injection of treating fluid into the space between the casing and the tubing strings for treating the well, or loading the same, or performing any other operation. And, if desired, lifting gas could likewise be injected through the system illustrated in FIG. 16 by forcing the same downwardly through the check valve CKV and outwardly into the bore of the casing C-1 below the receptacle R-1. All parts of the several elements shown in FIG. 16 are identical to those previously described and bear the same identifying numerals.

From the foregoing, it will be seen that an improved method and apparatus for treating, completing and operating wells either when the well is initially completed, or when it is being completely re-worked, has been disclosed. It is particularly to be noted that an installation has been disclosed in which surface controlled subsurface safety valves are installed in the well below the surface to provide for closing off flow from the well in the event of damage to any of the flow conductors of the well thereabove, and which is particularly adapted for installation during initial completion of the well. Also, the system is designed to facilitate servicing of the safety valves without expensive manipulation of the tubing strings in place in the well and without disturbing the well packers in multiple zone wells. Furthermore, it will be seen that an improved method has been provided for injecting lifting fluid or gas into the well through a removable and replaceable check valve which prevents back-flow of such lifting fluids or gases from the casing below the packer, and that the insertable and removable check valve assembly may be installed and removed without disturbing the tubing strings or packers.

It will further be seen that an improved structure has been provided for treating wells by injecting treating fluids into the well into the annular space between the casing and the flow conductors therein without disturbing the safety valves in place or removing the tubing or disturbing the packers in place in the well.

The foregoing description of the invention is explanatory only, and changes in the details of the constructions illustrated may be made by those skilled in the art, within the scope of the appended claims, without departing from the spirit of the invention.

What is claimed is:

1. Well flow control apparatus for a well having a wellhead and casing comprising:

a receptacle suspended in the well;

at least one lower tubing extending downwardly from the receptacle and in fluid communication with a producing formation;

packer means controlling flow through the casing-tubing annulus;

at least one upper tubing extending from the wellhead to the receptacle and in fluid communication with a lower tubing;

subsurface safety valve means in each upper tubing;

means releasably latching at least one upper tubing in said receptacle;

and a safety joint in each latched tubing which will part in response to an upward pull less than that required to lift the receptacle to prevent disturbing the receptacle in the event of an upward pull being executed on the safety joint while said latch means is engaged.

2. Well flow control apparatus for a well having a wellhead and casing comprising:

a receptacle suspended in the well;

a plurality of lower tubings extending downwardly from the receptacle with at least one tubing in fluid communication with a producing formation;

packer means controlling flow through the casing tubing annulus;

a guide head having a plurality of tubings suspended therefrom;

a subsurface safety valve in each tubing suspended from said guide head;

latch means for latching said tubings suspended from said guide head in said receptacle in fluid communication with said lower tubings;

an upper tubing secured to said guide head and extending upwardly to the wellhead;

at least one additional upper tubing extending between the guide head and wellhead;

and means sealing between the additional upper tubing and guide head.

3. The apparatus of claim 2 wherein:

a safety joint is provided in said upper tubing secured to the guide head which will part in response to an upward pull less than that required to lift the receptacle to prevent disturbing the receptacle in the event of an upward pull being exerted on the safety joint while said latch means is engaged.

4. The apparatus of claim 3 wherein:

the seal means is a sliding seal and the additional upper tubing telescopes into the guide head and is free to release from the guide head upon upward movement of the additional upper tubing.

5. The apparatus of claim 2 wherein:

the seal means is a sliding seal and the additional upper tubing telescopes into the guide head and is free to release from the guide head upon upward movement of the additional upper tubing.

* * * * *